US005402950A

United States Patent [19]

Blair et al.

[11] Patent Number: 5,402,950

[45] Date of Patent: Apr. 4, 1995

[54] PORTABLE SHREDDING MACHINE

[75] Inventors: Leonard Blair, Malvern; Frank Cizek, Bala Cynwyd, both of Pa.

[73] Assignee: Concept Products Corporation, Bryn Mawr, Pa.

[21] Appl. No.: 194,371

[22] Filed: Feb. 8, 1994

[51] Int. Cl.[6] ..... B07C 19/00

[52] U.S. Cl. ..... 241/101.7; 241/243; 241/260.1; 241/261

[58] Field of Search ..... 241/101.7, 243, 247, 241/260.1, 261, 292.1, 28

[56] References Cited

U.S. PATENT DOCUMENTS

| | | | |
|---|---|---|---|
| 2,925,079 | 2/1960 | Saxe | 241/101.7 X |
| 3,822,042 | 7/1974 | Roy . | |
| 4,015,782 | 4/1977 | Granite | 241/243 X |
| 4,214,713 | 7/1980 | Wright . | |
| 4,438,885 | 3/1984 | Martin | 241/101.7 X |
| 4,773,600 | 9/1988 | Metski . | |
| 4,884,757 | 12/1989 | Streicher | 241/101.7 X |
| 4,938,426 | 7/1990 | Koenig | 241/260.1 X |
| 4,951,883 | 8/1990 | Loppoli et al. | 241/260.1 X |
| 4,953,794 | 9/1990 | Paoli | 241/243 X |
| 5,137,219 | 8/1992 | Morey . | |
| 5,148,999 | 9/1992 | Curfman et al. | 241/260.1 |

FOREIGN PATENT DOCUMENTS

| | | | |
|---|---|---|---|
| 9000586 | 10/1990 | Netherlands | 241/260.1 |

*Primary Examiner*—Douglas D. Watts
*Attorney, Agent, or Firm*—Dowell & Dowell

[57] ABSTRACT

A trailer mounted shredding machine for reducing solid waste materials to a chip or fragmented consistency which includes an auger having a spiral conveying flight which includes a plurality of replaceable cutting teeth. The cutting teeth cooperate with replaceable anvil teeth mounted so as to extend within a conveying drum in which the auger is rotatably mounted. Material is loaded within a receiving hopper positioned above the auger and processed material is discharged through an opening which is axially oriented with respect to the auger. The processed materials are discharged onto an elevating conveyor which is driven by engagement with the auger drive shaft.

20 Claims, 7 Drawing Sheets

PORTABLE SHREDDING MACHINE

BACKGROUND OF THE INVENTION

1. Field of the Invention

This invention is generally directed to wood chipping, shredding and pulverizing machines and, more specifically, to a trailer mounted shredding machine for reducing waste timber, logs, lumber, tree limbs, roots and other wood fiber debris into a shredded mulch-like consistency. The shredding machine of the present invention incorporates an auger having a generally continuous flight wherein cutting teeth are mounted so as to form portions of the flight. The cutting teeth of the auger cooperate with replaceable anvil teeth which are mounted so as to form a portion of a semi-circular conveying drum which extends the length of the auger. The auger teeth not only serve to shred material being processed but also act, with the remaining portion of the auger flight, to convey the material to an axial discharge opening. Processed materials are discharged from the discharge opening onto an elevating conveyor. The elevating conveyor is pivotably moveable from a vertical travel position to a second working position and is driven by a friction drive element which engages the output end of the auger drive shaft.

The auger of the present invention is preferably driven by a hydraulic motor which is controlled by suitable hydraulic pumps driven by a gasoline or other motor source housed on the trailer.

2. History of the Related Art

In view of the ever increasing problem of waste disposal, it has become paramount that various waste products be processed into usable or recycled materials. In this respect, landfills in many areas have begun rejecting the disposal of various types of materials including grass clippings, pruning debris, and timber cuttings including trees and tree roots. In other landfills, special processing centers are provided for reducing organic fibrous materials including branches, tree trunks, tree root systems, discarded lumber and the like into a shredded material which may be utilized as a mulch. In addition to the foregoing, in some localities, shredded or processed wood fiber material is blended with other additives including waste manures to create potting soils and other organic medium for use in agriculture.

Unfortunately, not all areas have the facilities adequate to convert waste organic fibrous materials to useful products. Further, the use of centralized collection facilities requires that materials be hauled to the processing site. This is not always practical, especially when dealing with large amounts of waste dealt with in construction and in forest clearing or in instances, wherein individuals do not have access to vehicles which are adequate for hauling such waste materials.

In view of the foregoing, there have been numerous inventions directed to providing mobile chipping and shredding machines. Basic chipping and shredding units may be utilized by homeowners to process grass cutting, leaves, small branches and limbs, into a usable mulch material. Such shredding machines normally include a plurality of rotating blades mounted at the base of a receiving hopper. Material being fed into the blades is conveyed by a blower mechanism to bags appropriate piles. An example of such a machine is disclosed in U.S. Pat. No. 5,137,219 to Morey. Unfortunately, such small wood chipping machines are not adequate to shred larger or bulkier wood fiber material including logs, large limbs, tree roots, construction lumber and the like. Further, blower systems are inherently dangerous in that materials are discharged at considerable velocities and individuals can be struck by the debris being discharged.

Larger or more commercial portable wood shredding machines have been developed for processing heavy timber and large waste materials. Generally, such shredding machines either utilize fixed anvils which cooperate with rotating cutter blades or a plurality of intermeshing cutter blades to reduce the material being treated. In U.S. Pat. No. 3,822,042 to Roy, a demolition apparatus is disclosed which utilizes a plurality of cylindrical cutter elements which are generally aligned in a common plane. The material being processed passes from a hopper and between the cutting elements and is thereafter discharged vertically onto a conveying apparatus. Other examples of roller or auger cutters are disclosed in U.S. Pat. No. 4,938,426 to Koenig and German Patent 3 704 713 of Jul. 14, 1988.

An industrial type portable shredder having a fixed anvil and rotating cutter is disclosed in U.S. Pat. No. 4,773,600 to Metski. This patent discloses a trailered vehicle system for processing large portions of trees and tree stumps and includes a solid roller having a plurality of teeth embedded in the surface thereof. The teeth cooperate with fixed anvil teeth which extend inwardly from the housing surrounding the roller. The teeth on the roller cooperate with the teeth on the anvil to pulverize the material which is thereafter discharged to an underlying conveyor. The fixed anvil shredding system provides a benefit over other types of shredding systems in that the shredding auger or roller may be operated at extremely low rpm when compared to other systems. In the patent to Metski, it is stated that the cylinder on which the cutting teeth are mounted is operated under 50 rpm. This is compared with a more conventional rotation rate of other type cutting machines of 1500–1800 rpm. As discussed in the patent, by allowing the cylinder to rotate at lower rpm, damage to the teeth and other elements of the machine is significantly reduced, thereby decreasing downtime for maintenance and decreasing operating and repair costs.

Additional examples of prior art are disclosed in U.S. Pat. Nos 4,214,713 to Wright and U.S. Pat. No. 4,951,883 to Loppoli et al.

SUMMARY OF THE INVENTION

A portable shredding machine which includes a trailer frame on which is mounted a first housing for enclosing a power source such as a gasoline engine and a hydraulic control system including an appropriate hydraulic pump. A second housing is also mounted to the trailer which includes an open receiving hopper mounted above a semi-cylindrical conveying drum. Mounted along the conveying drum is an auger having a first or drive input end which is engaged with a suitable hydraulic motor and a second or output end which is mounted in a suspended bearing located within a discharge opening aligned axially with the auger.

The auger is provided with a generally continuous flight or spiral flange having a plurality of segments which are spaced from one another forming openings into which the base of a plurality of cutting elements are permanently secured such as by welding. The base members are oriented generally perpendicularly with respect to the auger but form portions of the auger flight. Removable cutting blades are securable to the base members so that the blades may be replaced after repeated usage or removed for sharpening. The cutting blades associated with the auger cooperate with a plurality of replaceable fixed anvil teeth which are mounted on separable plates which are secured so that portions of the inner surface of the plates are coextensive with the surface of the semi-cylindrical drum. In a preferred embodiment, a plurality of anvil segments are provided, allowing the replacement of a number of anvil teeth at the same time.

The replaceable anvil teeth may be of different sizes and configurations, thereby allowing differences in the ultimate size of the processed materials. Further, as the anvil teeth may be replaced easily by mounting bolts which are accessible exteriorly of the housing, a complete change in anvil elements can be made with a minimum amount of machine downtime.

In the present invention, the auger flight also serves to convey the material being shredded along the length of the auger to the discharge opening. Material discharged from the opening is receiving within a hopper associated with an elevating conveyor. The elevating conveyor includes a friction drive element which engages the output end of the auger drive shaft to thereby provide power to a continuous conveyor belt which elevates the processed materials to an adjustable discharge chute from which the material is loaded into awaiting transport vehicles.

It is a primary object of the present invention to provide a portable shredding machine which may be utilized to reduce large organic fibrous materials including tree trunks, stumps, construction materials and the like to a preselected size or consistency of chipped or shredded material which may be utilized as mulch or other products.

It is also an object of the present invention to provide a portable shredding machine which is extremely compact in configuration and which is capable of reducing both small and large sized organic fibrous materials to a chipped or shredded product and wherein the material being processed is conveyed by the cutting or shredding assembly to an axially aligned discharge opening where the material is further conveyed and elevated to transport vehicles by a conveyor assembly which is driven by the drive shaft associated with the cutting assembly.

It is another object of the present invention to provide a portable shredding machine for reducing both large and small organic fibrous debris to a shredded material wherein the size of the shredded material may be varied by exchanging anvil plates which have teeth which cooperate with a plurality of cutting teeth mounted to a rotating auger.

It is yet another object of the present invention to provide a portable shredding machine wherein the cutting elements include blades which are removably mounted to base portions which are secured in alignment with a spiral flight of a rotating auger, and wherein the cutting elements are reinforced by adjacent segments of the flight.

It is another object of the present invention to provide a shredding machine which is hydraulically driven and includes a rotating cutting auger assembly which cooperates with a fixed cutting anvil assembly to reduce materials to a shredded recyclable product wherein the cutting auger may be driven at reduced rates, thereby prolonging the life of the cutting elements associated both with the auger and the cooperating anvil assembly.

DESCRIPTION OF THE PREFERRED EMBODIMENT

Figure 3:
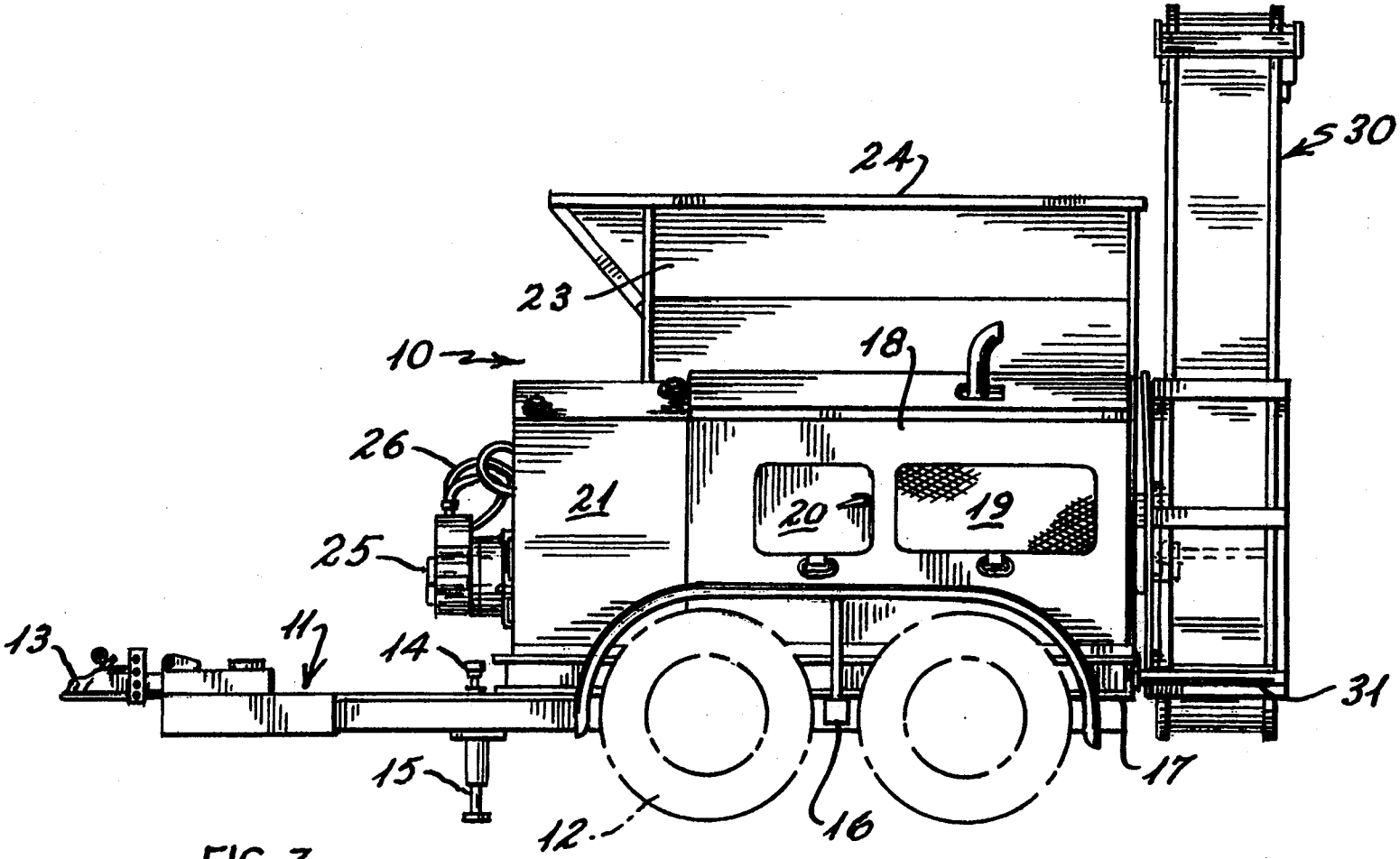
FIG. 3 is a left side elevational view of the portable shredding machine of the present invention.

With continued reference to the drawings, the shredding machine 10 of the present invention is shown as being mounted to a trailer 11 which is provided with appropriate axles for mounting the trailer to a plurality of wheels 12. The trailer is provided with a hitch assembly 13 by way of which the trailer may be secured to the ball assembly associated with a towing vehicle. When the trailer is not being towed, the trailer is provided with a jack 14 which is operable to lower a stabilizer of foot 15 as shown in FIG. 3. The trailer includes an undercarriage 16 on which is mounted a frame 17. A first housing 18 is mounted to the frame 17 in which an appropriate motor (not shown), such as a gasoline engine, is mounted. In addition, a hydraulic pump and hydraulic controls are also mounted within the housing 18. The hydraulic controls and motor are accessible through a pair of doors 19 and 20. Mounted forwardly with respect to the housing 18 is a containment area 21 in which a fuel tank is mounted.

Figure 1:
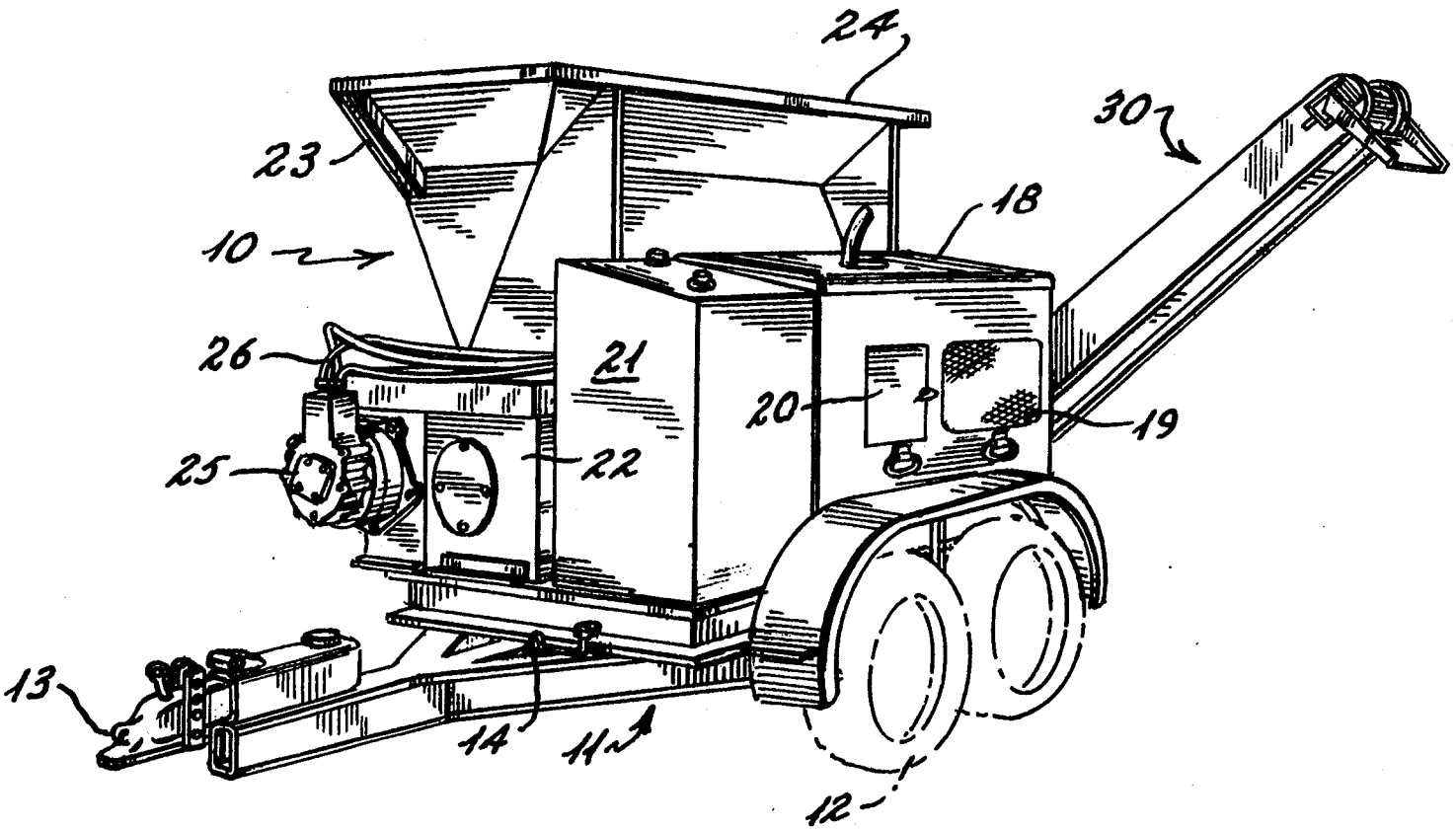
FIG. 1 is a front perspective view of the portable shredding machine of the present invention.

Also mounted on the frame 17 of the trailer 11 is a second housing 22 which includes an upper and open hopper 23. As shown, the top 24 of the hopper is elevated with respect to the ground so that it is virtually impossible for anyone working around the machine to accidentally gain access to the opening into the hopper, thereby significantly reducing the possibility of injuries. Also, as shown in FIG. 1, a reversible hydraulic motor 25 is mounted adjacent the second housing and is provided with a plurality of hydraulic lines 26 which connect the motor to the hydraulic pump mounted within housing 18.

Mounted to the rear of the trailer and to the frame 17 is an elevating conveyor assembly 30. The conveyor assembly is mounted on a support rod 31 which is secured and extends from the rear of the frame 17. The structure of the elevating conveyor will be described in greater detail hereinafter.

Figure 2:
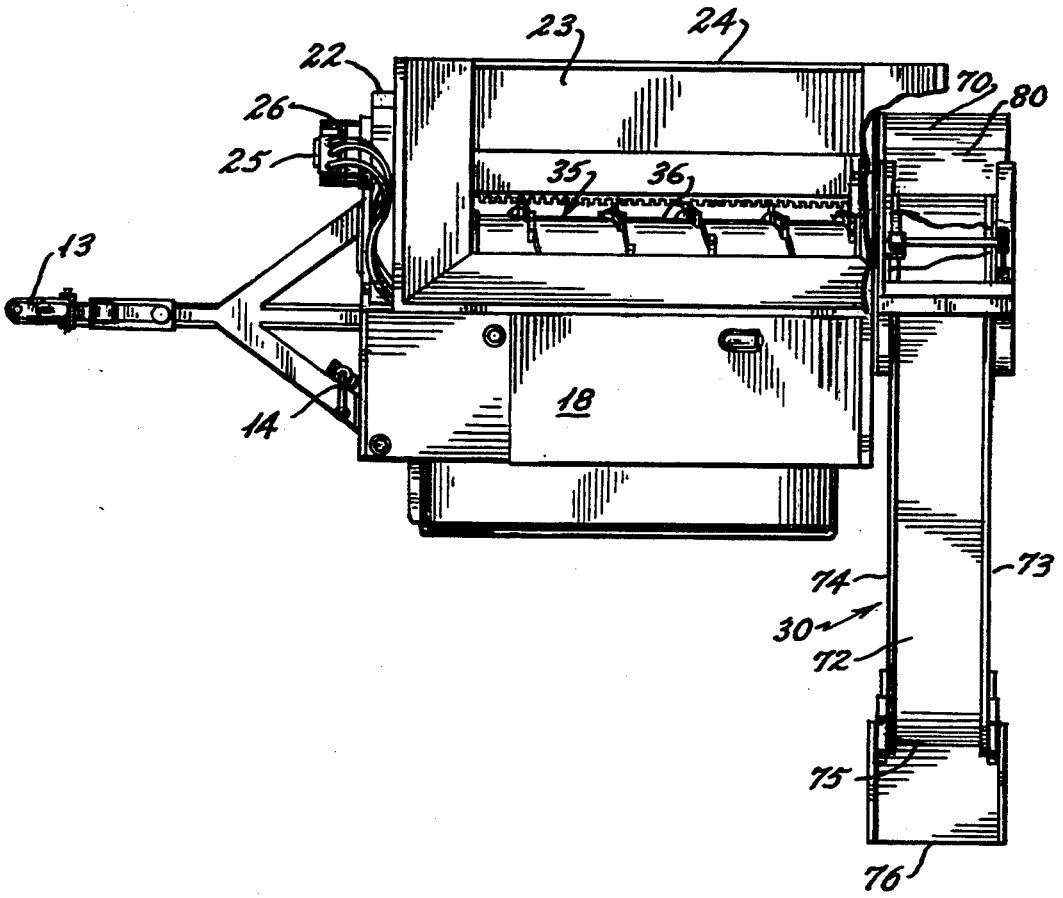
FIG. 2 is a top plan view of the portable shredding machine of the present invention.
Figure 6:
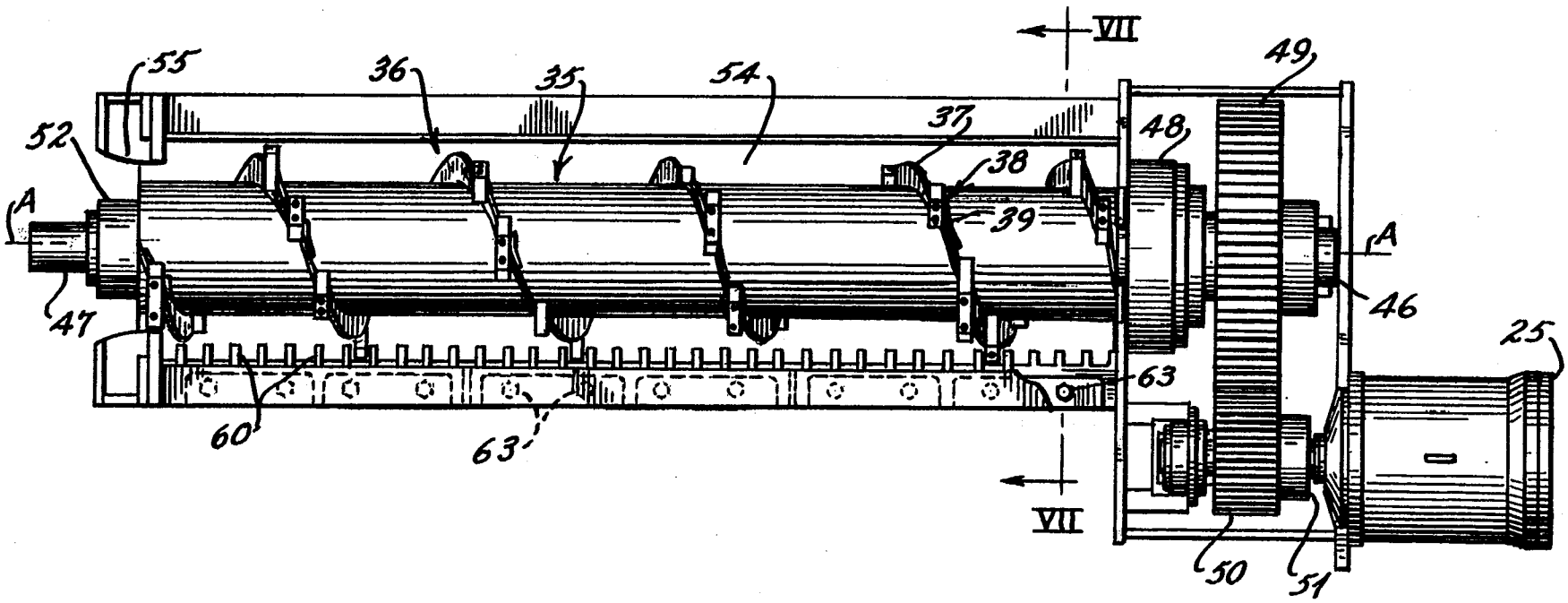
FIG. 6 is an enlarged top plan view of the rotating auger cutting assembly and the plurality of removable anvil assemblies and showing the drive arrangement with a hydraulic motor.
Figure 7:
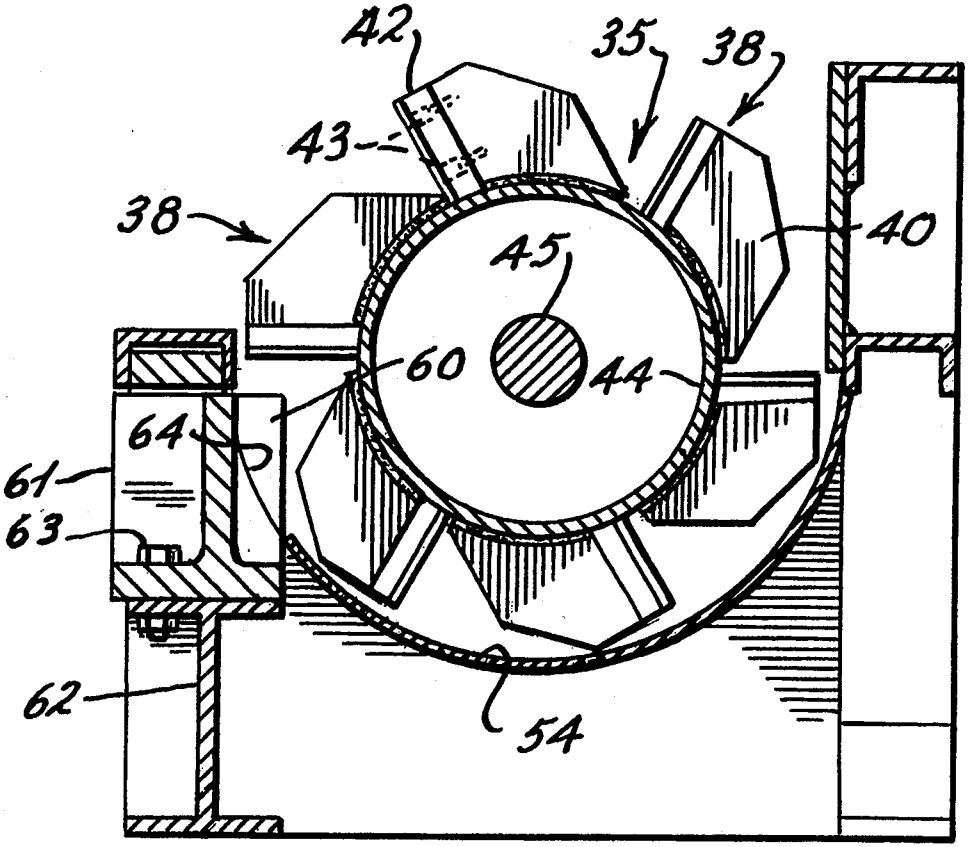
FIG. 7 is an enlarged cross-sectional view taken along lines VII of FIG. 6 showing the removable blades of the cutting elements associated with the rotating auger and also showing the mounting arrangement of the fixed teeth or cutting elements associated with the anvils.

With particular reference to FIGS. 2, 6 and 7, the shredding assembly of the present invention will be described in greater detail. As shown in FIG. 2, the hopper 23 which forms the upper portion of the housing 22 has inclined sidewalls by way of which material is directed into the lower portion of the housing in which there is mounted a rotatable auger 35. The auger is provided with an outwardly extending spiral flight 36 which is formed of a plurality of spiraling segments 37 which are spaced from one another to provide openings in which tooth or cutting assemblies 38 are mounted. As shown in FIG. 6, the tooth assemblies 38 are mounted generally perpendicularly with respect to the elongated axis A—A of the auger and are reinforced by plates 39 which are welded between the base or shank portion 40 of each tooth assembly 38. The shank portions of the teeth are more clearly shown in FIG. 7. In order to permit replacement of the cutting portions of the teeth assemblies 38, each tooth assembly 38 includes removable cutting blade or element 42 which is secured to the corresponding shank 40 by a pair of bolts 43 which are countersunk in appropriate openings provided in the cutting elements and the shanks, as is shown in FIG. 7. In view of the foregoing, whenever it becomes necessary to sharpen or replace the cutting elements 42, it is only necessary to remove the countersunk bolts 43.

Figure 4:
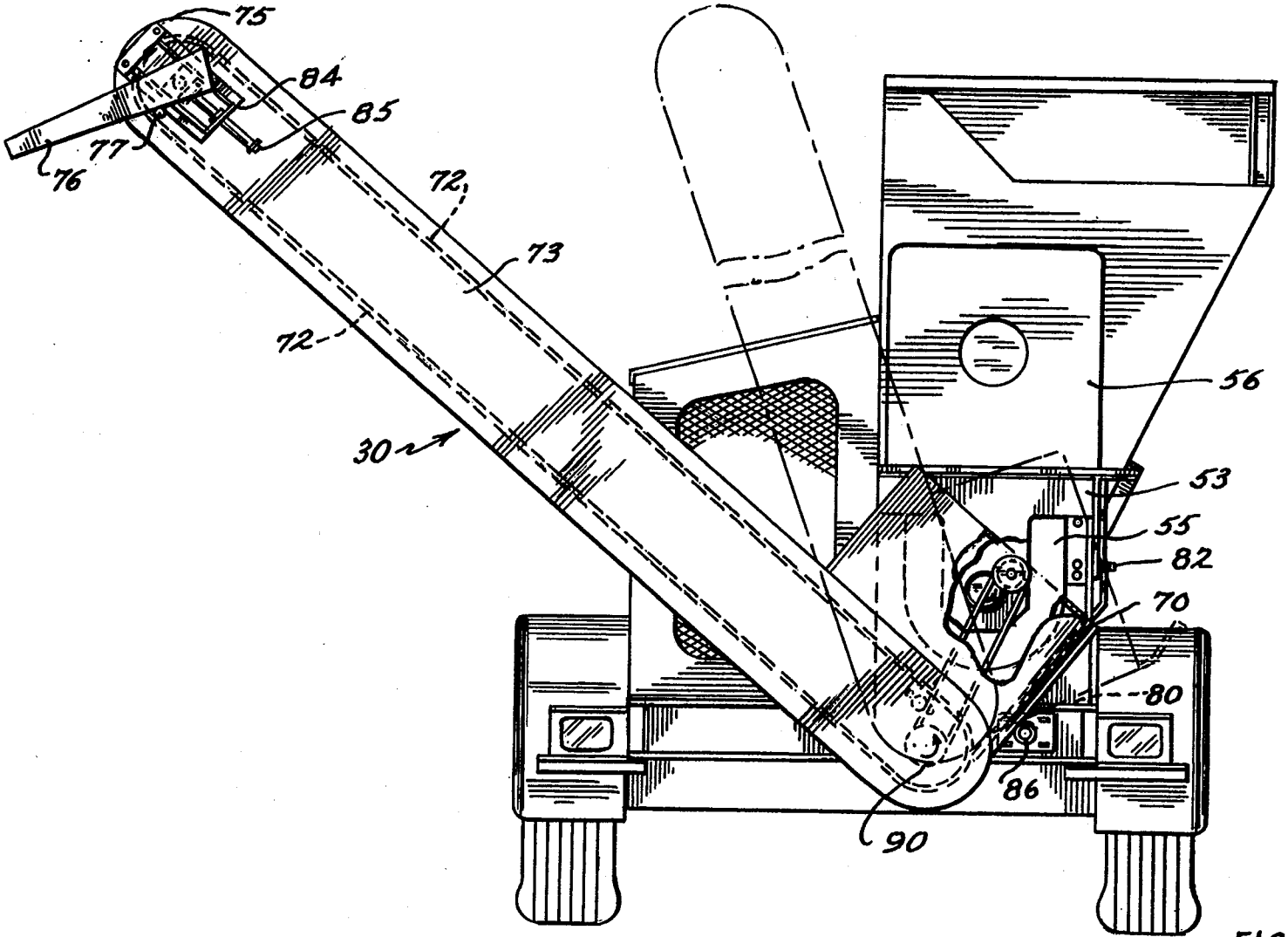
FIG. 4 is a rear plan view of the portable shredding machine of the present invention having portions broken away to show the drive engagement between the elevating discharge conveyor and the auger drive shaft and also showing, in dotted lines, the positioning of the elevating conveyor in a non-use position.

As further shown in FIG. 7, the auger includes an outer shell 44 which is mounted at its ends to a drive shaft 45. The drive shaft includes an input end 46 and an output end 47, both of which are shown in FIG. 6. The input end is mounted within a bearing assembly 48 and an appropriate gear 49 is provided which meshes with a drive gear 50 which is drivingly engaged by the output shaft 51 of the hydraulic motor 25. The outer or output end 47 of the drive shaft 45 is supported in a suspended bearing 52. The bearing is supported in a generally T-shaped plate 53 which is mounted at the rear of the second housing, as is shown in FIG. 4, wherein portions of the T-shaped plate have been removed to show details of the output shaft 47.

The auger 35 is mounted within a semi-cylindrical drum 54 which extends along the length of the second housing 22 in closely spaced relationship with respect to the outer portions of the auger flight 36. From the foregoing, it is observed that as the auger is rotated by the hydraulic motor 25, the spiral flight 36 will convey material along the length of the semi-circular drum 54 towards a discharge outlet 55 which is generally axially aligned with the outer surface of the auger 35. With specific reference to FIG. 4, the discharge outlet 55 is generally U-shaped in open configuration due to the T-shaped mounting plate 53 which extends down into the open area of the discharge outlet 55 in order to support the outlet end 47 of the drive shaft. When the machine is not in use, a protective cover 56 is provided which is hingedly mounted adjacent the T-shaped plate 55 and which may be swung down so as to cover the discharge outlet 55 and prevent access to the cutting elements.

The shredding machine of the present invention is designed to operate at generally low rpm and, in this respect, the rotating cutting blade assemblies 38 cooperate with stationary cutting blades 60 which are formed integrally with anvils 61 which are removably mounted to a frame support 62 by a plurality of bolts 63.

With particular reference to FIGS. 6 and 7, the fixed anvils 61 include a plurality of inwardly extending generally rectangularly formed teeth 60 which are spaced from one another by curved surface portions 64 which are designed to provide a continuous surface with respect to the semi-cylindrical drum 54. In this manner, material being shredded is prevented from entering into the area between the anvils 61 and the drum 54. As shown in FIG. 6, a pair of bolts 63 is utilized to mount each anvil to the frame support 62. Due to the alignment with the support 62, whenever it is necessary to change one of the anvils 61, when the replacement anvil is positioned in place and the bolts tightened, the teeth associated with the anvil are assured of being properly positioned relative to the cutting assemblies 38 which are formed as part of the spiral flight 36 of the auger 35. As further shown in FIG. 6, as the auger is rotated, the cutting blades 42 and a portion of the shank of each cutting assembly 38 will pass between adjacent teeth 60 of the fixed anvils, thereby cutting or shredding material therebetween. As the material is being cut, it is also simultaneously being conveyed towards the outlet 55 by the spiral flight of the auger.

In those instances where it becomes necessary to change the size of the shredded material, secondary anvils 61 may be utilized having teeth which are varied in dimension so as to create lesser or greater space between the fixed anvil teeth and the cutting elements 42 of the cutting blades assembly 38. Also, when any of the anvil teeth become worn or damaged, it is only necessary to remove the several mounting bolts 63 from the support frame 62.

Figure 5:
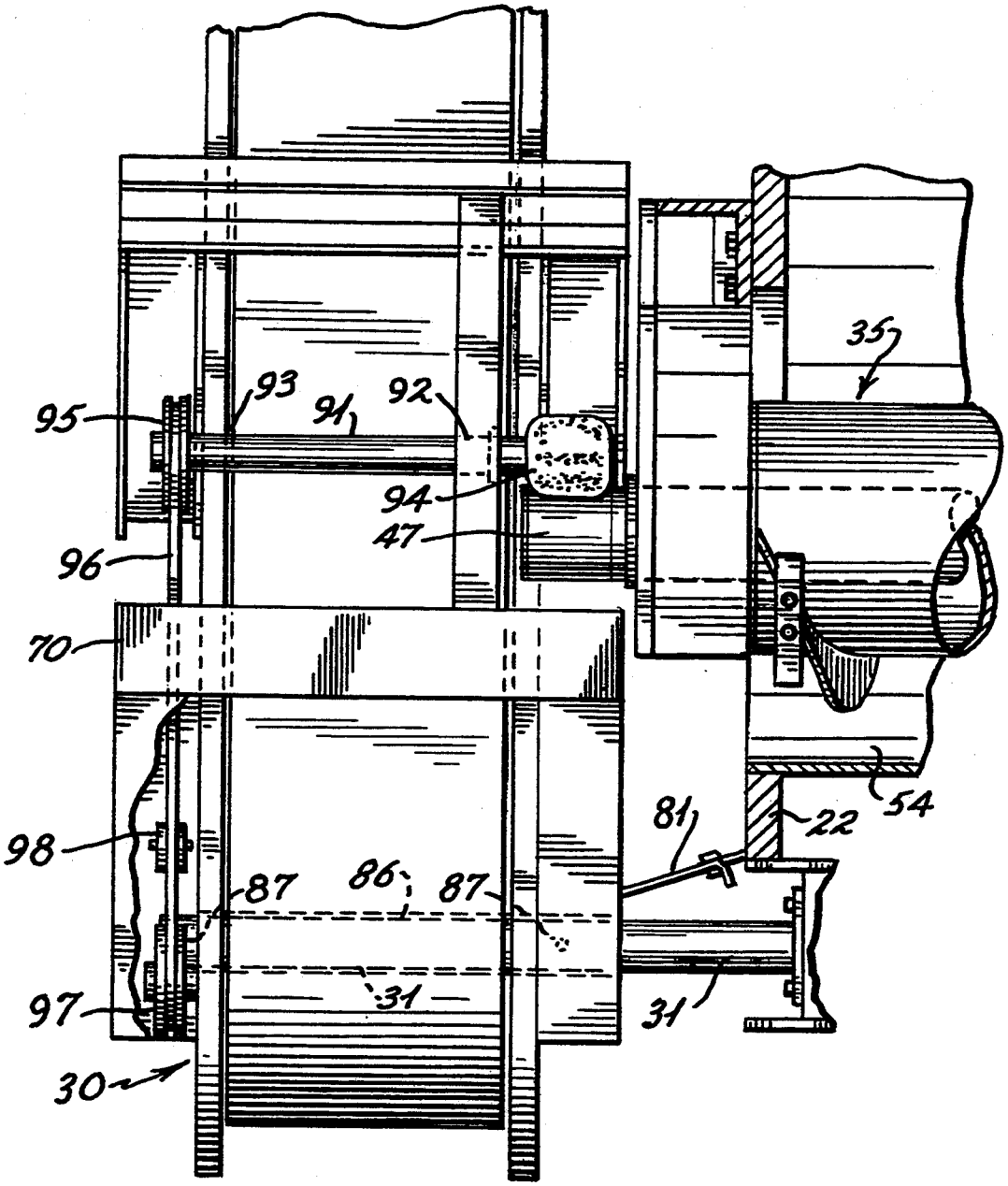
FIG. 5 is an enlarged plan view of the drive connection between the auger drive shaft and the elevating conveyor drive shaft.

In order to enable material being discharged through the discharge outlet 55 to be elevated and conveyed to an adjacent transport vehicle or to be discharged into a stockpile adjacent the machine, the machine is provided with an elevating conveyor 30. As shown in FIGS. 2, 4 and 5, the elevating conveyor includes an inlet bin or hopper 70 which initially receives material being discharged. The hopper 70 is mounted above the lower or receiving end of a continuous belt 72 which is mounted between a pair of side plates 73 and 74 which form edge walls for preventing the accidental discharge of material at the edges of the conveyor belt 72 as the material is being conveyed upwardly towards the discharge end 75 of the conveyor. Material being discharged from the end 75 of the elevating conveyor 30 is guided by a pivotable chute 76 to a point of deposit. The chute 76 is retained in position by an adjustable pin member 77 which is extendable through openings in one or both of the sides 73 and 74 of the conveyor 30. During transport, the chute 76 is raised and rotated so as to be positioned along the upper edge of the conveyor, as shown in FIG. 4.

Although the configuration of the bin 70 may be varied, the bin includes an end wall 80 shown in dotted line in FIG. 4 which is connected to the rear of the housing 22 by a flexible gasket 81, as shown in FIG. 5. The gasket prevents any material from falling between the bin 70 and the rear of the housing 22. An elongated flange 82 also extends upwardly from the base or end wall 80 for further ensuring that no material is accidentally spilled as it is being conveyed. In order to adjust tension on the conveyor belt 72, an adjustment assembly 84 is mounted adjacent the discharge end of the conveyor 30 and includes a bolt 85 which engages a plunger for urging a roller assembly along a track to thereby either increase or reduce tension on the belt.

As further shown in FIG. 4, the conveyor 30 is movable from a working position shown in full line to a transport position shown in dotted line. The conveyor is pivotable about the support pipe 31 shown in FIG. 5, which pipe extends through a larger pipe 86 which is welded to the end wall 80 of the bin 70 as is shown in FIGS. 4 and 5. It is therefore noted that the conveyor pivots about the point of connection between the pipe 86 and the pipe 31. Appropriate pins 87 are inserted through aligned openings through the pipes in order to restrict lateral movement of the conveyor with respect to the support pipe 31. When the conveyor is elevated to the dotted line position, the weight of the conveyor will cause the conveyor to remain in the upright position with the bin being supported against the pipe 31. When the conveyor is lowered to the use position shown in full line in FIG. 4, the conveyor will be supported partially by a drive assembly described below and the support pipe 31.

To drive the conveyor belt 72, the conveyor belt is mounted about a drive sprocket 90 on a conveyor drive shaft 91 which is mounted through bearings 92 and 93 provided in reinforcing elements of the bin 70. Input to the drive shaft 91 is provided by a contact or friction roller 94 which is mounted so as to engage the outer surface of the output end 47 of the auger drive shaft, as is shown in FIG. 5. It is preferred that the outer end portion of the drive shaft be somewhat knurled in order to increase the friction between the contact roller 94 and the drive shaft. A sprocket 95 is mounted to the opposite end of the conveyor drive shaft 91 and a chain or belt 96 is mounted between the sprocket and a driven sprocket 97 which is mounted to the drive sprocket 90 associated with the conveyor belt 72. An adjustment member 98 may be provided for adjusting tension of the belt or chain.

It will be noted from FIG. 4 that, as the conveyor is lowered into a use position, the contact roller 94 will engage the output end 47 of the auger drive shaft. In this manner, the chain or drive belt 96 will actually be placed in tension by the weight of the conveyor, thus increasing the frictional force between the contact roller 94 and the output end 47 of the drive shaft. The conveyor is thus supported by the driving arrangement between the contact roller and the output end of the auger drive shaft.

In the use of the shredding machine 10, the machine is trailered to a site where debris is to be processed. The trailer may be unhitched from the towing vehicle and the jack stand 14 lowered to level the machine for use. Thereafter, the conveyor 30 is lowered into an operating position as shown in FIG. 4 of the drawings. Thereafter, activation of the motor or engine associated with the machine will allow the hydraulic pump to be activated to initiate rotation of the hydraulic drive motor 25. As previously discussed, it is preferred that the drive motor be of the reversible type so that in the event any materials become lodged between the cutting elements, the drive auger may be reversely rotated to release the jammed materials. It is preferred that the auger drive shaft be operated between 20 to 70 rpm. In view of the low speed of drive shaft, it is anticipated that the cutting elements will exhibit prolonged life when compared with prior art shredding machines.

Material is thereafter loaded into the primary hopper 23 wherein the material descends towards the auger and is shredded by interaction of the knife assemblies carried by the rotating auger with the fixed anvil members. As the material is being shredded, it is also conveyed towards the discharge outlet 55, wherein the material is received within the bin 70 of the elevating conveyor 30. The material is thereafter conveyed by the conveyor belt 72 to the discharge chute 76 where the material is either discharged to a storage pile or into an awaiting vehicle for transport.

When it is desired to move the vehicle to a new site, the elevating conveyor 30 is raised to its non-use position, as shown in dotted line in FIG. 4, and the safety door 56 lowered to cover the discharge outlet 55 and thereafter the jack 14 raised to permit towing of the machine.

What is claimed is:

1. A shredding apparatus for shredding solid waste, including timber, lumber, branches, logs, stumps and related fibrous materials comprising:

a) a trailer;

b) a first housing mounted to said trailer and enclosing a power control means;

c) a second housing mounted to said trailer and having an open tapered hopper mounted above a semi-cylindrical conveyor drum;

d) an elongated auger mounted on a drive shaft extending along the length of said drum, said drive shaft and said elongated auger having a common elongated central axis, said drive shaft having a power input end and an output end;

e) a drive motor, means for drivingly connecting said drive motor to said power input end of said drive shaft;

f) a discharge opening generally axially aligned with said auger;

g) a support bearing extending into said discharge opening for supporting said output end of said drive shaft;

h) said auger having a generally continuous spiral conveyor flight extending outwardly therefrom and defined by a plurality of spirally aligned flight segments which are spaced from one another by openings;

i) a plurality of cutting teeth means having base portions mounted within said openings between said spirally aligned flight segments, said cutting teeth means being generally uniformly spaced along the length of said spiral flight intermediate each of said flight segments;

j) at least one anvil means having a plurality of anvil teeth extending inwardly of an inner arcuate surface thereof, means for removably mounting said at least one anvil means so that said inner arcuate surface is aligned with said semi-cylindrical conveyor drum, and said anvil teeth being spaced intermediate said cutting teeth means whereby as said auger is rotatably driven, said anvil teeth will cooperate with said cutting teeth means to shred material being axially conveyed by said auger.

2. The shredding apparatus of claim 1, in which said cutting teeth means are mounted substantially perpendicularly with respect to said auger.

3. The shredding apparatus of claim 2, in which said cutting teeth means include an outer cutting blade, and means for removably connecting said outer cutting blade to said base portions of said cutting teeth means.

4. The shredding apparatus of claim 3, including a plurality of anvil means, and means for removably mounting each of said anvil means in aligned relationship along the length of said auger.

5. The shredding apparatus of claim 4, in which said anvil means are mounted on a support frame having a plurality of spaced openings therein, and bolt means extending through said anvil means and into said openings, whereby said anvil means are automatically aligned with said generally semicircular drum when said bolt means are mounted through said openings.

6. The shredding apparatus of claim 5, in which said bearing means is generally T-shaped and said discharge opening is generally U-shaped.

7. The shredding apparatus of claim 6, including an elevating conveyor mounted to said trailer adjacent said discharge opening.

8. The shredding apparatus of claim 7, in which said elevating conveyor includes a receiving bin, a continuous conveyor belt mounted in alignment with said receiving bin, and means for drivingly connecting said continuous belt with the output end of said drive shaft.

9. The shredding apparatus of claim 8, in which said means for drivingly connecting said continuous conveyor belt includes a friction roller means, said friction roller means being mounted to said receiving bin and being selectively engageable with said output end of said drive shaft, a pair of sprocket means, drive means interconnecting said sprocket means, a drive drum mounted to said continuous belt, and said drive drum being connected to one of said sprocket means.

10. The shredding apparatus of claim 9, in which said elevating conveyor means is pivotably mounted to a support member extending from said trailer, said conveyor means being pivotable from a first non-use position wherein said friction roller means is spaced from said output end of said drive shaft to a second use position wherein said friction roller means engages said output end of said drive shaft, and means for retaining said conveyor means in said first position.

11. The shredding apparatus of claim 10, in which said drive motor is a reversible hydraulic motor.

12. The shredding apparatus of claim 1, including an elevating conveyor means mounted adjacent said discharge opening, a support member extending from said trailer, means for pivotably mounting said elevating conveyor to said support means whereby said conveyor may be pivotably moved relative to said trailer from a first relatively vertical position for traveling to a second inclined position.

13. The shredding apparatus of claim 12, in which said elevating conveyor includes a continuous conveyor belt, and means for driving said belt by drivingly connecting said belt with said output end of said drive shaft.

14. The shredding apparatus of claim 13, in which said means for driving said belt includes a friction roller means selectively engageable with said output end of said drive shaft, a drive drum, said conveyor belt being supported by said drive drum, and means for connecting said friction roller means to said drive drum.

15. The shredding apparatus of claim 1, including a plurality of anvil means, and means for removably mounting each of said anvil means in aligned relationship along the length of said auger.

16. The shredding apparatus of claim 15, in which said anvil means are mounted on a support frame having a plurality of spaced openings therein, and bolt means extending through said anvil means and into said openings, whereby said anvil means are automatically aligned with said generally semicircular drum when said bolt means are mounted through said openings.

17. The shredding apparatus of claim 1, in which said bearing means is generally T-shaped and said discharge opening is generally U-shaped.

18. A shredding apparatus for shredding solid waste, including timber, lumber, branches, logs, stumps and related fibrous materials comprising:

a) a trailer;

b) a power control means mounted to said trailer;

c) a housing mounted to said trailer and having an open tapered hopper mounted above a semi-cylindrical conveyor drum;

d) an elongated auger mounted on a drive shaft extending along the length of said drum, said drive shaft and said elongated auger having a common elongated central axis, said drive shaft having a power input end and an output end;

e) a drive motor, means for drivingly connecting said drive motor to said power input end of said drive shaft;

f) a discharge opening generally axially aligned with said auger;

g) a support bearing extending into said discharge opening for supporting said output end of said drive shaft;

h) said auger having a generally continuous spiral conveyor flight extending outwardly therefrom;

i) a plurality of cutting teeth means having base portions mounted along said spiral conveyor flight, said cutting teeth means being spaced along the length of said spiral flight;

j) at least one anvil means having a plurality of anvil teeth extending inwardly of an inner arcuate surface thereof, means for removably mounting said at least one anvil means so that said inner arcuate surface is aligned with said semi-cylindrical conveyor drum, and said anvil teeth being spaced intermediate said cutting teeth means whereby as said auger is rotatably driven, said anvil teeth will cooperate with said cutting teeth means to shred material being axially conveyed by said auger.

19. The shredding apparatus of claim 18, in which said cutting teeth means include an outer cutting blade, means for removably connecting said outer cutting blade to said base portions of said cutting teeth means, a plurality of anvil means, and means for removably mounting each of said anvil means in aligned relationship along the length of said auger.

20. The shredding apparatus of claim 18, including an elevating conveyor mounted to said trailer adjacent said discharge opening, said elevating conveyor including a receiving bin, a continuous conveyor belt mounted in alignment with said receiving bin, and means for drivingly connecting said continuous belt with the output end of said drive shaft.

* * * * *